US012281869B2

(12) United States Patent
Kam

(10) Patent No.: US 12,281,869 B2
(45) Date of Patent: Apr. 22, 2025

(54) TOY PROJECTILE WITH INTERCHANGEABLE LAUNCH TIP

(71) Applicant: Ao Jie Plastic Toys Factory Ltd., Kwun Tong (HK)

(72) Inventor: Chi Hang Kam, Kwun Tong (HK)

(73) Assignee: Ao Jie Plastic Toys Factory Ltd., Kwun Tong (HK)

( * ) Notice: Subject to any disclaimer, the term of this patent is extended or adjusted under 35 U.S.C. 154(b) by 105 days.

(21) Appl. No.: 18/185,347

(22) Filed: Mar. 16, 2023

(65) Prior Publication Data

US 2024/0310142 A1 Sep. 19, 2024

(51) Int. Cl.
*F41B 11/70* (2013.01)
*F41B 11/641* (2013.01)
*F41B 11/89* (2013.01)

(52) U.S. Cl.
CPC ..... *F41B 11/70* (2013.01); *F41B 11/641* (2013.01); *F41B 11/89* (2013.01)

(58) Field of Classification Search
CPC ..... F41B 11/70; F41B 11/641; F41B 11/89
USPC ..... 124/6
See application file for complete search history.

(56) References Cited

U.S. PATENT DOCUMENTS 2,315,242 A * 3/1943 Briggs ..... F41B 11/641 60/269
2,601,555 A 6/1952 Pope
2,678,847 A 5/1954 Caird
2,725,868 A 12/1955 Foster
2,762,357 A 9/1956 Foster
3,236,521 A 2/1966 Knott
3,765,396 A 10/1973 Kienholz et al.
5,058,561 A * 10/1991 Starr ..... F41B 11/641 124/64
5,115,794 A 5/1992 Moormann
5,242,323 A * 9/1993 Rappaport ..... F41B 11/642 124/66

(Continued)

OTHER PUBLICATIONS

"Ultimate 7-In-1 Modular Nerf Blaster From a Blastzooka" published user "severedhed" on Feb. 3, 2016; https://www.instructables.com/Ultimate-7-In-1-Modular-Nerf-Blaster-From-a-Blastz/ (Year: 2016).*

(Continued)

*Primary Examiner* — Samir Abdosh
(74) *Attorney, Agent, or Firm* — LaMORTE & Associates PC

(57) ABSTRACT

A projectile launcher that can be selectively configured to either launch toy ball projectiles or launch toy rocket projectiles. The projectile launcher is a pneumatic launcher that has a main tube. The main tube terminates with a launch head. A slide tube engages the main tube in a telescoping manner. The relative movement of the slide tube and the main tube displaces air through the launch head. The projectile launcher is normally configured to launch toy ball projectiles. By adding a launch adapter to the launch head, the projectile launcher can be configured to launch toy rocket projectiles. The launch adapter has an elongated launch tube and a base. The base is selectively attachable to the launch head. This concentrically aligns the elongated launch tube with the main tube. A toy rocket projectile can be paced over the elongated launch tube.

8 Claims, 5 Drawing Sheets

(56) References Cited

U.S. PATENT DOCUMENTS

| | | | | |
|---|---|---|---|---|
| 5,377,655 | A | 1/1995 | Arad | |
| 5,377,656 | A | 1/1995 | Lewinski et al. | |
| 5,415,153 | A * | 5/1995 | Johnson | A63H 27/14 124/63 |
| D385,008 | S | 10/1997 | Lamont | |
| 5,735,256 | A | 4/1998 | Monk | |
| 6,321,737 | B1 * | 11/2001 | Johnson | F41B 11/641 124/75 |
| 7,410,124 | B2 * | 8/2008 | Miller | B64U 70/50 244/63 |
| D599,433 | S | 9/2009 | Zore | |
| 7,938,100 | B2 | 5/2011 | Udwin | |
| 7,938,110 | B2 | 5/2011 | Udwin | |
| D666,275 | S | 8/2012 | DeVore | |
| 8,671,926 | B1 * | 3/2014 | Mahlstedt | F41B 11/89 124/65 |
| D718,824 | S | 12/2014 | Huang | |
| 9,062,928 | B2 | 6/2015 | Appleton | |
| D786,986 | S * | 5/2017 | Su | D21/570 |
| D790,639 | S | 6/2017 | Yu | |
| D792,543 | S | 7/2017 | Lakatos | |
| D832,939 | S * | 11/2018 | Chen | D21/573 |
| 10,928,154 | B1 | 2/2021 | Kam | |
| 2008/0127958 | A1 * | 6/2008 | Mullin | F41B 11/89 124/56 |
| 2009/0084372 | A1 * | 4/2009 | Witzigreuter | F41B 11/681 124/45 |
| 2011/0271941 | A1 * | 11/2011 | Meggs | F41B 11/89 124/31 |
| 2014/0283809 | A1 * | 9/2014 | Huebl | F41B 11/60 124/56 |
| 2022/0226745 | A1 | 7/2022 | Hilt | |

OTHER PUBLICATIONS

"Blastzooka" Nerf wiki page; https://nerf.fandom.com/wiki/Blastzooka (Year: 2023).*

* cited by examiner

TOY PROJECTILE WITH INTERCHANGEABLE LAUNCH TIP

BACKGROUND OF THE INVENTION

1. Field of the Invention

In general, the present invention relates to toy projectile launchers that project foam balls, foam rockets, and foam aircraft into flight. More particularly, the present invention relates to the structure of toy projectile launchers and the interface between the launcher and the toy projectile being launched.

2. Prior Art Description

Toy projectile launchers have a long history and have designs that depend primarily on the type of toy projectile being launched. For example, a toy bow and arrow would typically use a string to launch an arrow into flight. A toy dart gun would typically use a compressed spring to launch a toy dart into flight. If the toy projectile is made of lightweight foam, such as a foam ball or a foam rocket, pneumatics are typically used to launch the projectile into flight. The foam projectile is typically positioned at the end of a tube. A piston is then moved in the tube to create pneumatic pressure. The pneumatic pressure forces the foam projectile out of the tube with enough velocity for the foam projectile to take flight.

In the toy industry, it is not unusual for different pneumatic launchers to be customized to the sizes and shapes of different projectiles. For instance, most pneumatic launchers that are designed to launch balls have launch tubes that are designed to hold projectile balls of a particular diameter. The projectile balls are launched from inside the launch tube. A slight obstruction is disposed inside the launch tube. The projectile ball presses against the obstruction as the launcher is activated and pneumatic forces build in the launch tube. Once the pneumatic pressure reaches a specific value, the projectile ball is displaced past the obstruction and the pneumatic pressure is released. This launches the projectile ball into flight.

A slightly different dynamic is utilized to launch a foam rocket or a foam aircraft. Due to the size and shapes of the projectiles, the projectiles are launched from the outside of the launch tube. The toy rocket or toy aircraft has a channel formed into its body that enables the toy rocket or the toy aircraft to slide around the launch tube. The channel in the projectile is long and significant friction exists between the channel and the narrow launch tube. When the pneumatic launcher is activated, pressure builds in the narrow launch tube until the frictional forces are overcome and the projectile rapidly launches away from the narrow launch tube.

Due to the different loading and launching dynamics that are used to launch foam balls and foam rockets, toy pneumatic launchers are typically designed to launch only one of the two types of projectiles. That is, toy pneumatic launchers are designed to either launch foam balls from inside the launch tube or launch foam rockets from outside the launch tube. Prior art attempts to create a pneumatic launcher that can launch both types of projectiles has resulted in compromised design where the foam balls are undersized for the launcher and/or the foam rockets are oversized for the launcher. Both undersized foam balls and oversized foam rockets can be dangerous since they either fly too slow or fly fast enough to cause harm.

A need therefore exists for an improved pneumatic launcher that is specifically designed to launch both foam balls and foam rockets/aircraft, without having to compromise on the size and shape of the projectiles. This need is met by the present invention as described and claimed below.

SUMMARY OF THE INVENTION

The present invention is a projectile launcher that can be selectively configured to either launch toy ball projectiles or launch toy rocket projectiles. The projectile launcher is a pneumatic launcher that has a main tube. The main tube terminates at a first end with a launch head. A slide tube engages the main tube in a telescoping manner. The relative movement of the slide tube and the main tube creates a change of air pressure within the main tube that displaces air through the launch head.

The projectile launcher is normally configured to launch toy ball projectiles. However, by adding a launch adapter to the launch head, the projectile launcher can be configured to launch toy rocket projectiles. The launch adapter has an elongated launch tube and a base. The base is selectively attachable to the launch head. This concentrically aligns the elongated launch tube with the main tube.

A toy rocket projectile can be paced over the elongated launch tube with a friction fit. By moving the slide tube relative to the main tube, the air pressure within the main tube can be increased. This increase in air pressure is shared with the elongated launch tube. Once the air pressure overcomes the friction retention forces, the toy rocket launcher will launch into flight. The launch adapter can then be removed, and the projectile launcher again used to launch toy ball projectiles.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention toy projectile launching system can be embodied in many ways, only one exemplary embodiment of the present is illustrated and described. The exemplary embodiment has been selected in order to set forth one of the best modes contemplated for the invention. The illustrated embodiment, however, is merely exemplary and should not be considered a limitation when interpreting the scope of the appended claims.

Figure 1:
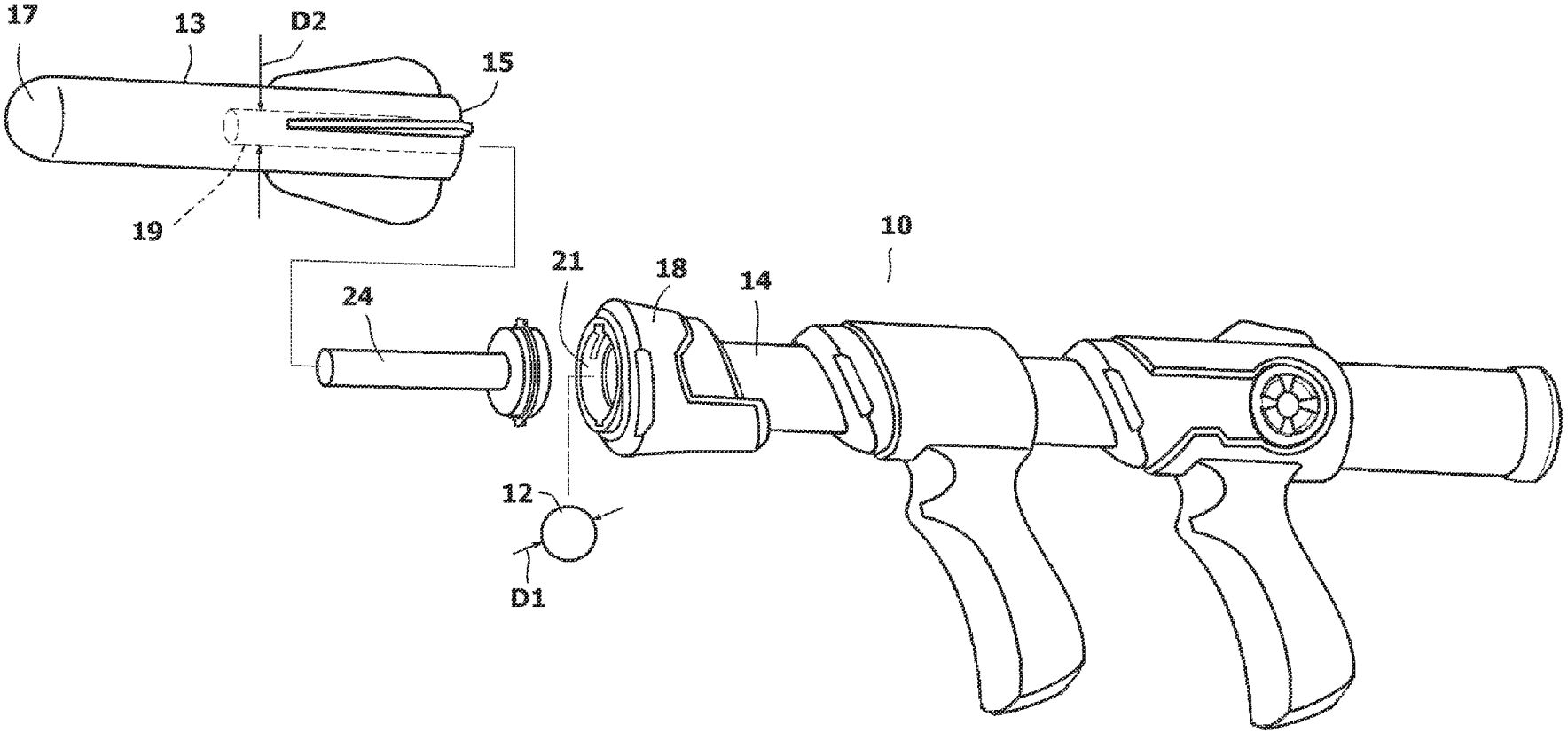
FIG. 1 shows an exemplary embodiment of a toy projectile launching system with a ball projectile, a rocket projectile and a rocket launch adapter.
Figure 2:
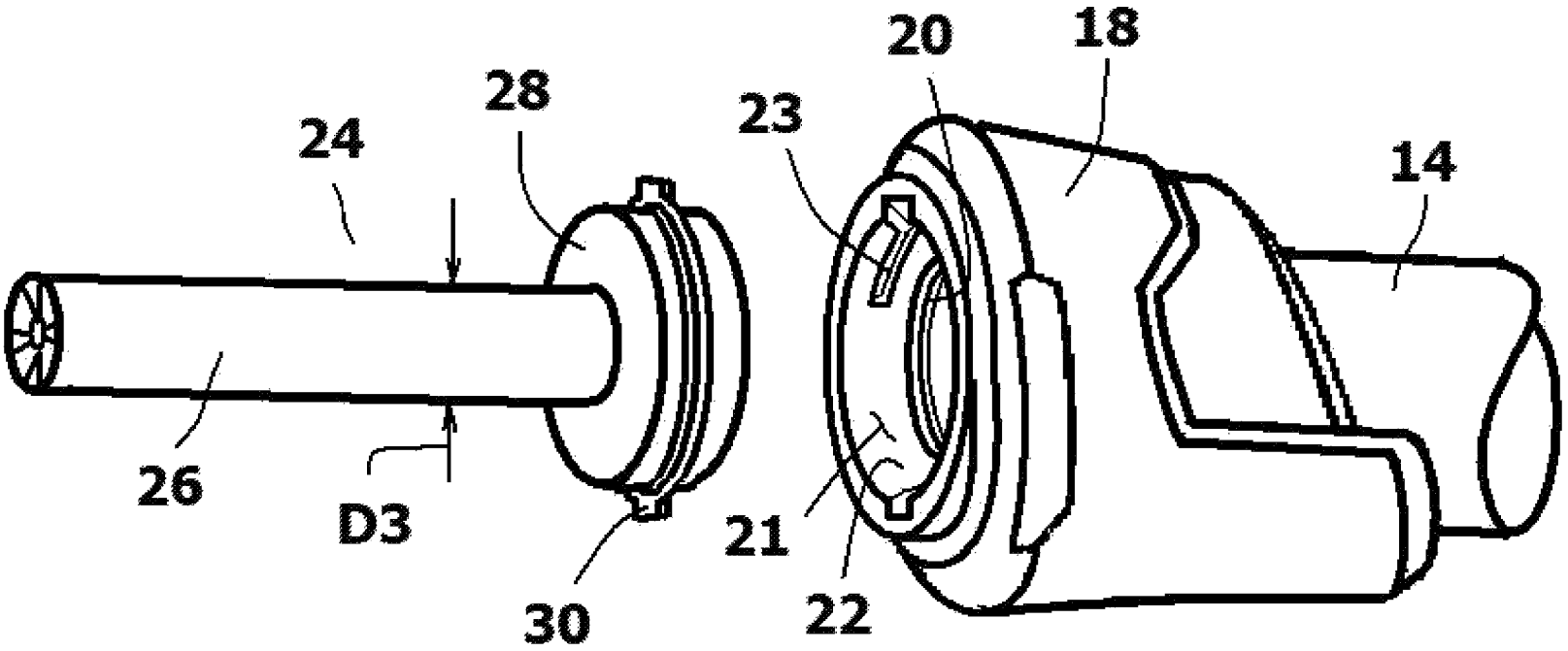
FIG. 2 is an enlarged view of the launch head of the toy projectile launching system and the rocket launch adapter.
Figure 3:
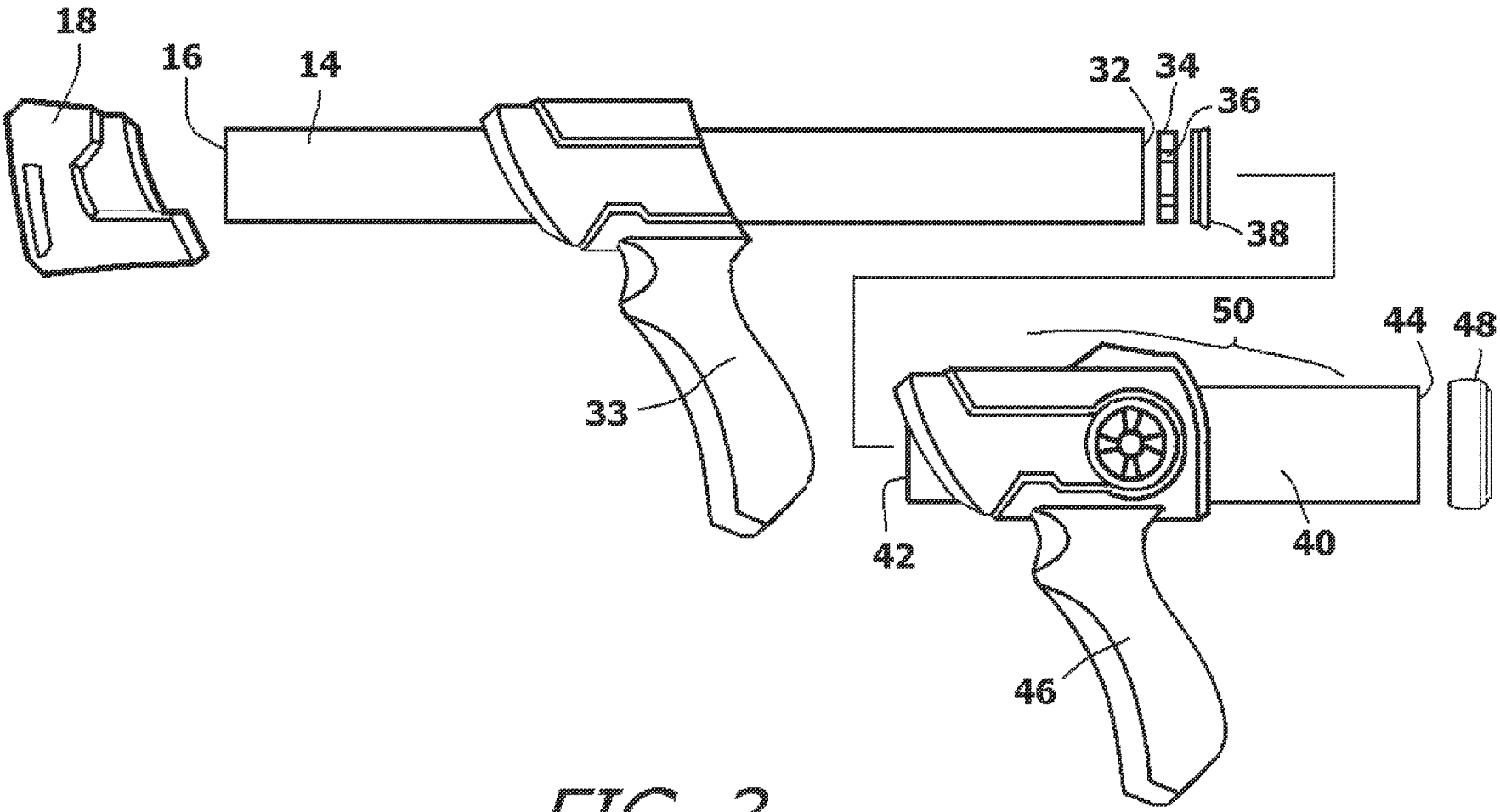
FIG. 3 is an exploded view of the toy projectile launching system shown in FIG. 1.

Referring to FIG. 1 in conjunction with FIG. 2 and FIG. 3, a toy projectile launching system 10 is shown. The toy projectile launching system 10 is designed to both internally launch toy ball projectiles 12 and externally launch toy rocket projectiles 13. The toy ball projectiles 12 are made of foam and have a first diameter D1. The toy rocket projectiles 13 are elongated and have a first end 15 and an opposite second end 17. A cylindrical bore opening 19 is formed into the toy rocket projectile 13 from the center of the second end 17. The bore opening 19 has a second diameter D2, which is smaller than the first diameter D1 of the toy ball projectiles 12.

The toy projectile launching system 10 includes a main tube 14. The main tube 14 has a first end 16 and a constant inner diameter that extends along its length. The inner diameter is slightly larger than the first diameter D1 of the toy ball projectiles 12. The first end 16 of the main tube 14 is open, wherein the first end 16 of the main tube 14 terminates with a launch head 18.

The launch head 18 defines an exit port 21 through which the toy ball projectiles 12 can be launched. A restriction ring 20 is disposed in the exit port 21. The restriction ring 20 has an inner diameter that is slightly smaller than the first diameter D1 of the toy ball projectile 12. A collar 22 encircles the exit port 21. The collar 22 is internally provided with a mechanical coupling 23, such as threads or the bayonet coupling that is illustrated. Accordingly, in order for any toy ball projectile 12 to pass into or out of the main tube 14, the toy ball projectile 12 must pass through the restriction ring 20 and the collar 22 within the launch head 18.

A rocket launch adapter 24 is provided. The rocket launch adapter 24 has an elongated launch tube 26 with an outer diameter D3. The outer diameter D3 is the same as, or close to, the diameter D2 of the bore opening 19 in the toy rocket projectile 13. The outer diameter D3 is also smaller than either the inner diameter of the main tube 14 and the inner diameter of the restriction ring 20, Furthermore, when the elongated launch tube 26 is at least as long as the bore opening 19 in the toy rocket projectile 13. The elongated launch tube 26 extends into a base 28. The base 28 has a diameter that fits within the collar 22 of the launch head 18. A flange coupling 30 radially extends from the base 28. The flange coupling 30 is either a threaded connector or a bayonet connector that can selectively engage the mechanical coupling 23 formed into the collar 22. Once the rocket launcher adapter 24 is attached to the launch head 18, the elongated launch tube 26 is concentrically aligned with the main tube 14 and any air exiting the launch head 18 from the main tube 14 is directed through the elongated launch tube 26.

Referring to FIG. 3, it will be understood that the main tube 14 has a first end 16 and an opposite second end 32. A front pump handle 33 is attached to the main tube 14 a short distance behind the launch head 18. The second end 32 of the main tube 14 terminates with a stop 34. The stop 34 contains one or more small vent holes 36 that enable a small volume of air to pass through the stop 34 at the second end 32 of the main tube 14. A tube seal 38 is also affixed to the stop 34 outside of the main tube 14. The tube seal 38 and the second end 32 of the main tube 14 are received within a wider slide tube 40 in a telescoping manner. The tube seal 38 on the main tube 14 creates an air seal against the interior of the slide tube 40.

The slide tube 40 has a first end 42 and an opposite second end 44. The first end 42 is open and receives the second end 32 of the main tube 14. The opposite second end 44 of the slide tube 40 is sealed closed by an end cap 48. A second pump handle 46 is affixed to the slide tube 40 near its open first end 42. Accordingly, the second pump handle 46 is affixed to the slide tube 40 near its first end 42 and the end cap 48 is affixed to the slide tube 40 at its second end 44. This creates a slide subassembly 50. The slide subassembly 50 can reciprocally slide along the main tube 14. As the slide subassembly 50 is retracted, air is drawn through the main tube 14 and into the slide tube 40 through vent holes 36 in the stop 34 of the main tube 14. As the slide subassembly 50 is advanced over the main tube 14, the slide subassembly 50 displaces air into the main tube 14 through the vent holes 36, therein increasing the air pressure within the main tube 14. The slide subassembly 50 can be moved relative the main tube 14 by grasping and moving the first pump handle 33 and the second pump handle 46.

Figure 4:
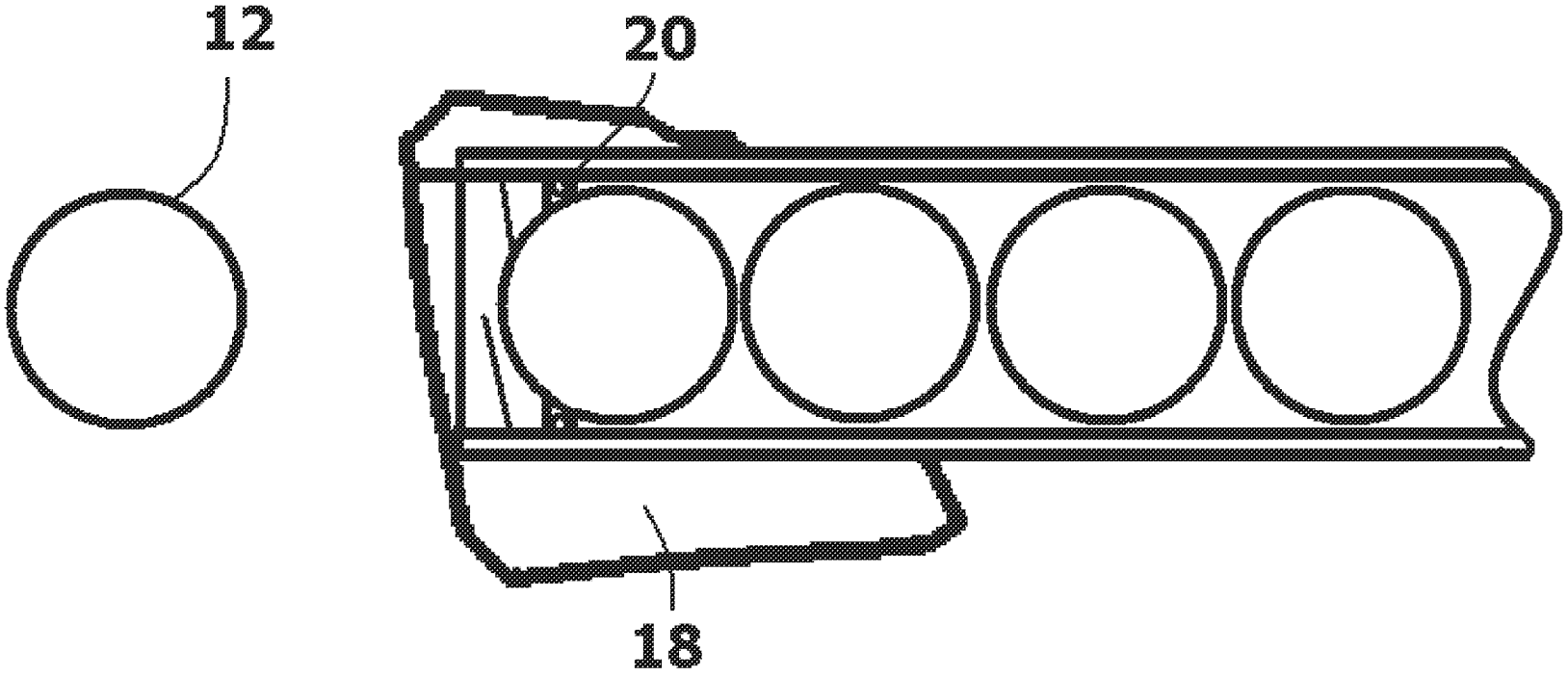
FIG. 4 shows an enlarged view of the launch head of the toy projectile launching system loaded with toy ball projectiles.

Referring to FIG. 4 in conjunction with FIG. 1 and FIG. 3, it will be understood that to launch toy ball projectiles 12, the rocket launch adapter 24 is not installed. The toy ball projectiles 12 are preferably made of polymeric foam and are compressible. The toy ball projectiles 12 have a diameter D1, but can be forced through the smaller diameter restriction ring 20 at the launch head 18. The toy ball projectiles 12 are manually inserted into the main tube 14 through the launch head 18. To fire the toy ball projectiles 12, the slide subassembly 50 is manually retracted by separating the first pump handle 33 from the second pump handle 46. The slide subassembly 50 is then advanced by moving the first pump handle 33 and the second pump handle 46 toward each other. This movement of the slide subassembly 50 displaces air out of the slide tube 40 and into the second end 32 of the main tube 14. The movement of air directs the toy ball projectiles 12 toward the restriction ring 20 at the first end 16 of the main tube 14. The lead toy ball projectile 12 then wedges in the restriction ring 20, creating a blockage. The air pressure in the main tube 14 increase behind the blockage as the slide subassembly 50 is advanced. The pressure increases until it is sufficient to deform the toy ball projectile 12 and force the toy ball projectile 12 through the restriction ring 20 and into flight. The process can then be repeated until all of the toy ball projectiles 12 are displaced out of the main tube 14.

Figure 5:
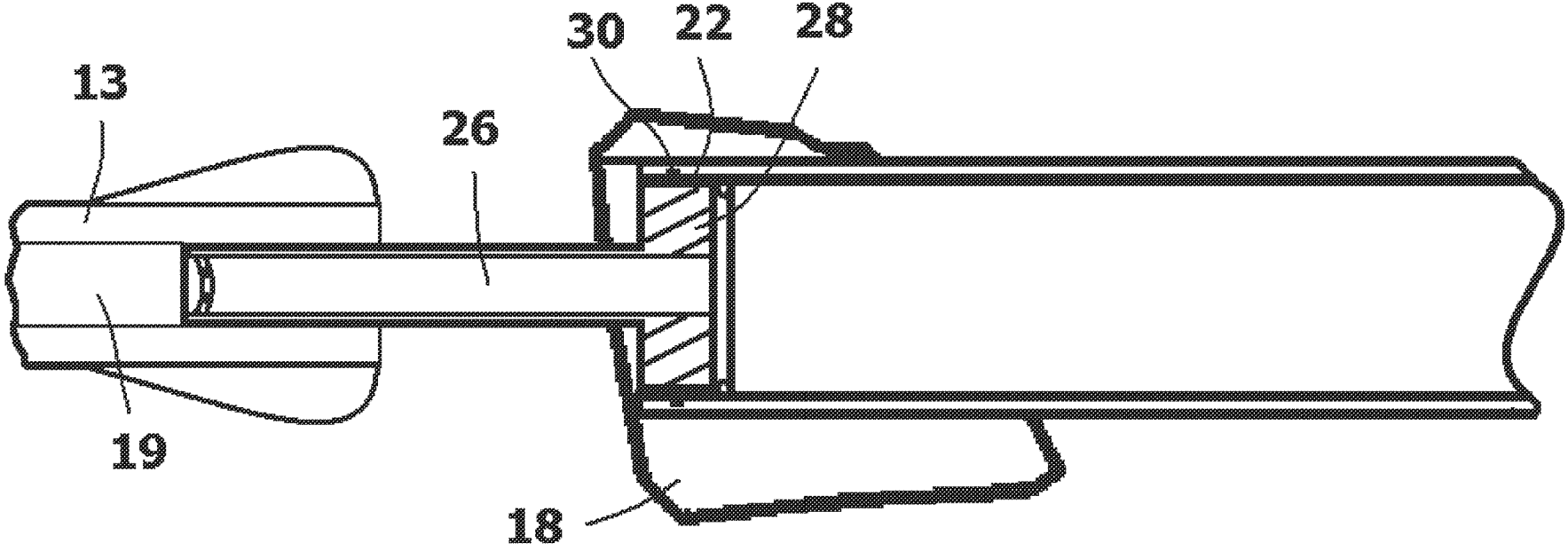
FIG. 5 shows an enlarged view of the launch head of the toy projectile launching system loaded with a rocket projectile.

Referring to FIG. 5 in conjunction with FIG. 2, it can be seen that to launch a toy rocket projectile 13, the rocket launch adapter 24 is first attached to the launch head 18. The rocket launch adapter 24 has an elongated launch tube 26 that extends the base 28. The base 28 is advanced into the collar 22 of the launch head 18. A flange coupling 30 that radially extends from the base 28 is received by the mechanical coupling 23 formed into the collar 22 and the components are locked with a turn. Once the rocket launch adapter 24 is attached to the launch head 18, the elongated launch tube 26 is concentrically aligned with the main tube 14.

The elongated launch tube 26 is advanced into the bore opening 19 of the toy rocket projectile 13. Friction retains the toy rocket projectile 13 in place. To fire a toy rocket projectile 13, the slide subassembly 50 is manually retracted and advanced using the first pump handle 33 and the second pump handle 46. This movement displaces air out of the main tube 14 and into the elongated launch tube 26. The toy rocket projectile 13 blocks the elongated launch tube 26. The air pressure in the main tube 14 increases behind the blockage as the slide subassembly 50 is advanced. The pressure increases until it is sufficient to overcome the friction and forces the toy rocket projectile 13 into flight.

It will be understood that the embodiment of the present invention that is illustrated and described is merely exemplary and that a person skilled in the art can make many variations to that embodiment. For instance, the length, width and shape of the launch assembly can be changed to accommodate different sized projectiles. The shape and appearance of the handles are a matter of design choice. All such embodiments are intended to be included within the scope of the present invention as defined by the claims.

What is claimed is:

1. A toy projectile launcher, comprising:

a main tube that terminates at a first end with a launch head, wherein said main tube has an inside diameter;

a slide tube that engages said main tube in a telescoping manner, and wherein relative movement of said slide tube and said main tube creates a change of air pressure within said main tube that displaces air through said launch head;

a launch adapter having an elongated launch tube and a base, wherein said elongated launch tube has an outside diameter that is smaller than said inside diameter of said main tube and wherein said base is selectively attachable to said launch head, therein concentrically aligning said elongated launch tube with said main tube, and a restriction ring within said launch head having an inner diameter, wherein said inner diameter of said restriction ring is smaller than said inner diameter of said main tube and said inner diameter of said restriction ring is larger than said outside diameter of said elongated launch tube.

2. The toy projectile launcher according to claim 1, further including a mechanical connector for selectively attaching said launch adapter to, and detaching said launch adapter from, said launch head.

3. The toy projectile launcher according to claim 2, wherein said mechanical connector is selected from a group consisting of threaded connectors and bayonet connectors.

4. A method of converting a toy pneumatic launcher from a first configuration intended to fire toy ball projectiles to a second configuration intended to fire toy rocket projectiles, said method comprising:

providing a pneumatic launcher having a main tube, a launch head at one end of said main tube, and a slide tube that engages said main tube in a telescoping manner, wherein, said main tube has an inside diameter and relative movement of said slide tube and said main tube creates a change of air pressure within said main tube that displaces air through said launch head;

providing a restriction ring within said launch head, wherein restriction ring has an inner diameter that is smaller than said inner diameter of said main tube;

providing a launch adapter having an elongated launch tube, wherein said elongated launch tube has an outside diameter and said inner diameter of said restriction ring is larger than said outside diameter of said elongated launch tube; and attaching said launch adapter to said launch head, wherein said elongated launch tube extends from said launch head away from said main tube.

5. The method according to claim 4, wherein providing a launch adapter includes providing a launch adapter with a base from which said elongated launch tube extends, wherein said base is selectively attachable to, and detachable from, said launch head.

6. The method according to claim 5, wherein said launch head contains a collar that receives said base and mechanically attaches to said base with a mechanical connection.

7. A toy projectile launcher, comprising:

a main tube that terminates at a first end, wherein said main tube has an inside diameter;

a slide tube that engages said main tube in a telescoping manner, and wherein relative movement of said slide tube and said main tube creates a change of air pressure within said main tube that displaces air through said first end;

a removable adapter having an elongated launch tube and a base, wherein said elongated launch tube has an outside diameter that is smaller than said inside diameter of said main tube and wherein any air displaced out of said first end of said main tube is directed through said elongated launch tube; and a restriction ring within said launch head having an inner diameter, wherein said inner diameter of said restriction ring is smaller than said inner diameter of said main tube and said inner diameter of said restriction ring is larger than said outside diameter of said elongated launch tube.

8. The toy projectile launcher according to claim 7, wherein said main tube has an inside diameter and said elongated launch tube has an outside diameter that is smaller than said inside diameter of said main tube.

* * * * *